US006655865B2

(12) United States Patent
Yanagi et al.

(10) Patent No.: US 6,655,865 B2
(45) Date of Patent: Dec. 2, 2003

(54) PRINTING APPARATUS AND METHOD

(75) Inventors: Haruyuki Yanagi, Tokyo (JP); Yasuo Miyauchi, Tokyo (JP); Yuji Nakano, Kanagawa (JP); Koichiro Kawaguchi, Kanagawa (JP); Nobutsune Kobayashi, Kanagawa (JP); Hiroyuki Saito, Kanagawa (JP); Akira Okamoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/058,412

(22) Filed: Jan. 30, 2002

(65) Prior Publication Data

US 2002/0113363 A1 Aug. 22, 2002

(30) Foreign Application Priority Data

Jan. 31, 2001 (JP) ..... 2001-024552

(51) Int. Cl.[7] ..... B41J 11/44
(52) U.S. Cl. ..... 400/705; 400/582; 400/74
(58) Field of Search ..... 400/705, 70, 76, 400/61, 582, 74

(56) References Cited

U.S. PATENT DOCUMENTS 5,001,515 A 3/1991 Nomura et al. ..... 355/200
5,131,770 A * 7/1992 Kanemitsu ..... 400/568
5,903,365 A 5/1999 Iwata et al. ..... 358/498
6,267,467 B1 * 7/2001 Otsuki ..... 347/43
6,336,703 B1 * 1/2002 Otsuki ..... 347/41
6,336,706 B1 * 1/2002 Otsuki ..... 347/43
6,471,351 B1 * 10/2002 Ishikawa et al. ..... 347/104
2002/0024556 A1 * 2/2002 Otsuki

FOREIGN PATENT DOCUMENTS

JP 04049072 A * 2/1992 ..... B41J/13/00
JP 04363266 A * 12/1992 ..... B41J/2/51

* cited by examiner

*Primary Examiner*—Charles H. Nolan, Jr.
(74) *Attorney, Agent, or Firm*—Fitzpatrick, Cella, Harper & Scinto

(57) ABSTRACT

An area on the printing sheet which can be printed through a single scanning operation of a printing head is divided into a plurality of smaller areas. The printing sheet is transported a distance corresponding to each divided area to print the image using different nozzles of the printing head for each divided area. When a back end portion of the printing sheet is printed, the distance transported is reduced to set inoperative nozzles that are not used for the printing operation. Then, when the printing sheet slips out from the upstream roller pair and it is then detected that the printing sheet is to be transported a distance longer than predetermined amount of rotation of the roller, the inoperative nozzles are used to shift an operative nozzle range depending on the extra amount of rotation. Thus, the extra transportation of the printing sheet is corrected.

16 Claims, 12 Drawing Sheets

PRINTING APPARATUS AND METHOD

BACKGROUND OF THE INVENTION

1. Field of the Invention

The present invention relates to a printing apparatus and method for a printer, a copy machine, a facsimile terminal equipment, or the like, and specifically, to correction of the deviation of a printed position resulting from an error in transportation of a printing sheet.

2. Description of the Related Art

Conventional printing apparatuses such as printers, copy machines, and facsimile terminal equipment are equipped with a mechanism which transports a printing sheet as a printing medium. The mechanism includes a transportation roller, a pinch roller pressing the printing sheet against the transportation roller and holding the printing sheet between the pinch roller and the transportation roller, a device for causing the pinch roller to apply a pressing force on the printing sheet, and other devices. Such transportation mechanism executes a transporting operation for the printing sheet fed by a sheet feeding section, in a printing area by a printing head, and two pairs of such transportation mechanisms are generally provided before and behind the printing area, respectively. Thus, the printing sheet is precisely transported in the printing area, and during the transportation, predetermined tension is applied to the printing sheet to keep it flat over a wide area.

FIG. 11 is a sectional view mainly showing the transporting mechanism for the printing sheet in a conventional example of a printing apparatus based on an ink jet method.

In the figure, a printing head 7 mounted in a carriage portion 5 executes a scanning operation in a direction perpendicular to the drawing sheet, and during the scanning operation, ejects ink for performing a printing operation. In relation to the printing area covered by the printing head, a printing sheet P is transported, under the carriage portion 5, from right to left in the figure while substantially keeping its horizontal position. More specifically, as the above-stated two pairs of transportation mechanisms, a pair of a transportation roller (hereinafter referred to as "LF roller") 36 and a pinch roller 37 is provided in an upstream side of the printing area, in which the printing sheet is transported, and a pair of a sheet discharging roller 41 and a spur 42 is provided in a downstream side of the printing area. Among these rollers, the pinch roller 37 is rotatably supported on a rotation shaft provided in a pinch roller holder 30. The pinch roller holder 30 is urged by a pinch roller spring 31 so that the pinch roller 37 can be pressed against the transportation roller 36. A pressing mechanism (not shown) similarly applies a pressing force which is applied between the sheet discharging roller 41 and the spur 42. The two pairs of rollers respectively hold the printing sheet P therebetween, and a driving mechanism (not shown) rotationally drives the transportation roller 36 and the sheet discharging roller 41, thereby causing the printing sheet P to be transported a predetermined distance for each one scanning operation of the printing head.

However, it is known that the above-described transportation mechanism may cause a deviation of transporting position of the printing sheet: when the printing sheet P is transported and a back end thereof slips out from the transportation roller 36 and the pinch roller 37 holding the printing sheet therebetween, the printing sheet P may be transported more than an expected predetermined distance, thereby a relative position of the printing head to the printing sheet P deviates from the regular one. As a result, a position (position of a printed image) of an ink dot formed on the printing sheet P with ink ejected from the printing head deviates from a standard position, thereby degrading the printed image.

FIGS. 12A and 12B show a positional relationship between the transportation roller 36 and the pinch roller 37. As shown in FIG. 12B, the transportation roller 36 has a length corresponding to a width of the printing sheet P. On the other hand, a plurality of pinch rollers 37, each of which is shorter than the transportation roller 36, are disposed correspondingly to the transportation roller. With this configuration, when the back end of the printing sheet P slips out from the transportation roller 36 and the pinch rollers 37, the pinch rollers 37 move toward the transportation roller a distance corresponding to a thickness of the printing sheet P, which has been held by the pinch rollers 37 and the transportation roller 37 between there. Urging force of the pinch roller 37 associated with this movement causes the printing sheet P to be transported an extra distance, that is, longer than the expected predetermined distance. At the same time, the transportation roller rotates an amount corresponding to the above extra transported distance.

To deal with such an error in transportation, it is considered that for example, a brake may be provided to stop rotation of the transportation roller to restrain the printing sheet P from being transported an extra distance when the sheet slips out. However, in this case, load torque required to drive the transportation roller increases, so that disadvantageously, a higher-grade drive motor must be used, and transportation speed cannot be increased.

SUMMARY OF THE INVENTION

The object of the present invention is to provide a printing apparatus and method that can use a simple configuration to reduce the deviation of a printed image position resulting from a behavior of the printing sheet when the back end of the printing sheet slips out from the upstream roller pair during transportation.

In a first aspect of the present invention, there is provided a printing apparatus which uses a printing head having a plurality of printing elements disposed thereon to perform printing on a printing medium, the apparatus comprising:

transportation means having a transportation roller and urging means for applying a pressing force on the printing medium to press the printing medium against the transportation roller, to perform transportation of the printing medium;

detection means for detecting an amount of rotation of the transportation roller to determine an amount of transportation of the printing medium; and correction means for shifting an operative range of the printing element by using an inoperative printing element among the plurality of printing elements of the printing head correspondingly to the amount of transportation which the detection means detects when the pressing force applied on the printing medium by the urging means disappears, to correct a deviation of a position of the printing element to the printing medium, the deviation being caused by transporting of the amount of transportation detected by the detection means.

In a second aspect of the present invention, there is provided a printing method which uses a printing head having a plurality of printing elements disposed thereon to perform printing on a printing medium, the method comprising the steps of:

providing transportation means having a transportation roller and urging means for applying a pressing force on the printing medium to press the printing medium against the transportation roller, to perform transportation of the printing medium;

detecting an amount of rotation of the transportation roller to determine an amount of transportation of the printing medium; and shifting an operative range of the printing element by using an inoperative printing element among the plurality of printing elements of the printing head correspondingly to the amount of transportation which the detecting step detects when the pressing force applied on the printing medium by the urging means disappears, to correct a deviation of a position of the printing element to the printing medium, the deviation being caused by transporting of the amount of transportation detected by the detecting step.

With the above configuration, during transportation of the printing medium, when the pressing force, by urging means for pressing the printing medium against the transportation roller in order to generate transportation force, applied on the printing medium disappears, that is, when the printing medium slips out from the transportation roller and the urging means, and even when the printing medium is transported an extra distance due to its slip-out, those of the plurality of printing elements of the printing head, which are usually not used for printing, are used to shift the operative range of the printing elements so as to correct the deviation of the positions of the printing elements relative to the printing medium correspondingly to a transportation detected by the detecting means. This prevents a position of a printed image from deviating from a predetermined position expected from an already printed image.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of the present invention will be described below in detail with reference to the drawings.

Embodiment 1

A printing apparatus according to this embodiment has an automatic sheet feeding unit installed therein, and in this state, has mechanism sections including the sheet feeding unit, a sheet transporting section, a sheet discharging section, a carriage section, and a cleaning section. Further, in addition to these mechanism sections, the printing apparatus is equipped with a control section in the form of a substrate which control an operation of each mechanism section, described later, and which executes processing for printing data, transportation of a printing sheet or the like. The control section has a CPU, a ROM, a RAM and others as in a case with well-known printing apparatuses. Further, printing heads used in this printing apparatus are based on an ink jet method. Specifically, the printing heads employ what is called the BJ method which uses thermal energy generated by an electric-thermal transforming element to generate a bubble in ink to allow the ink to be ejected using pressure of the bubble.

Figure 1:
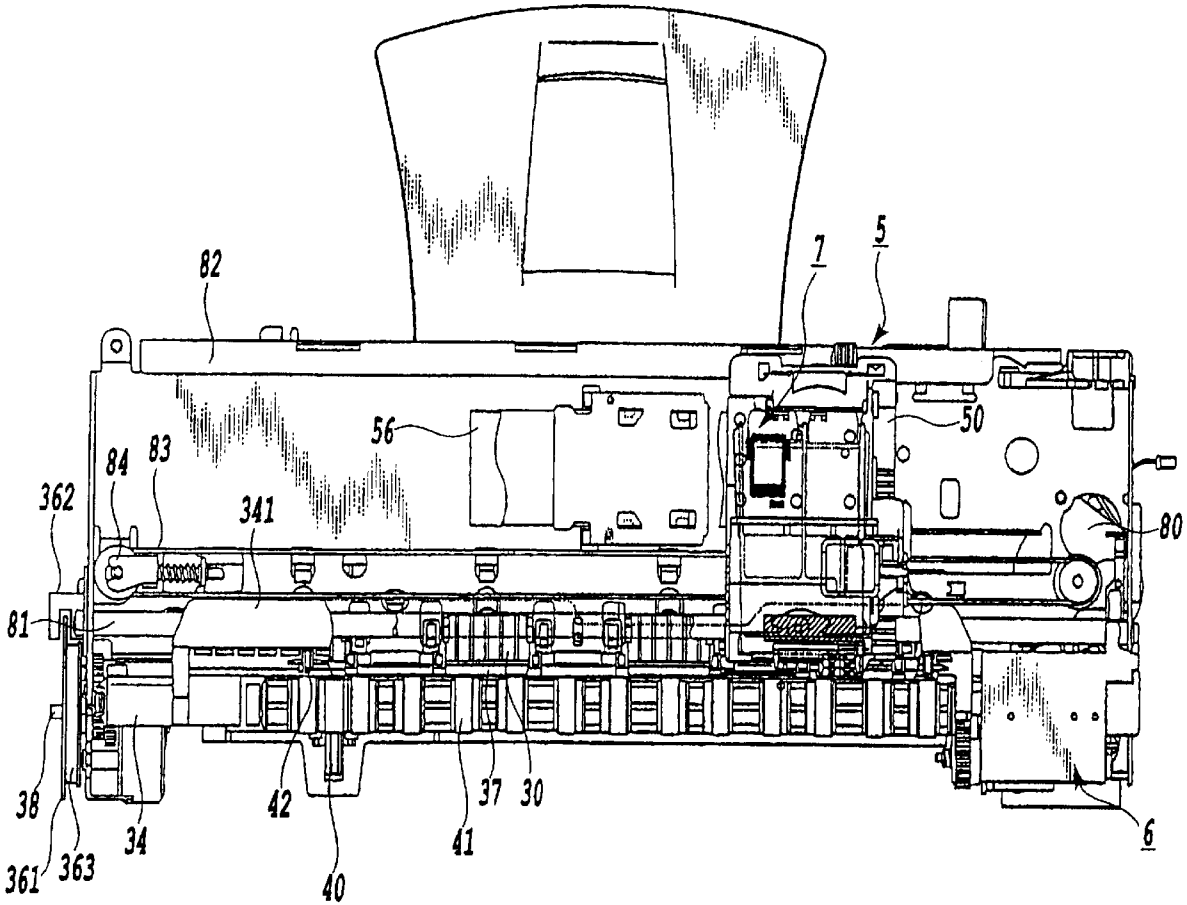
FIG. 1 is a front view of a printing apparatus according to a first embodiment of the present invention.
Figure 2:
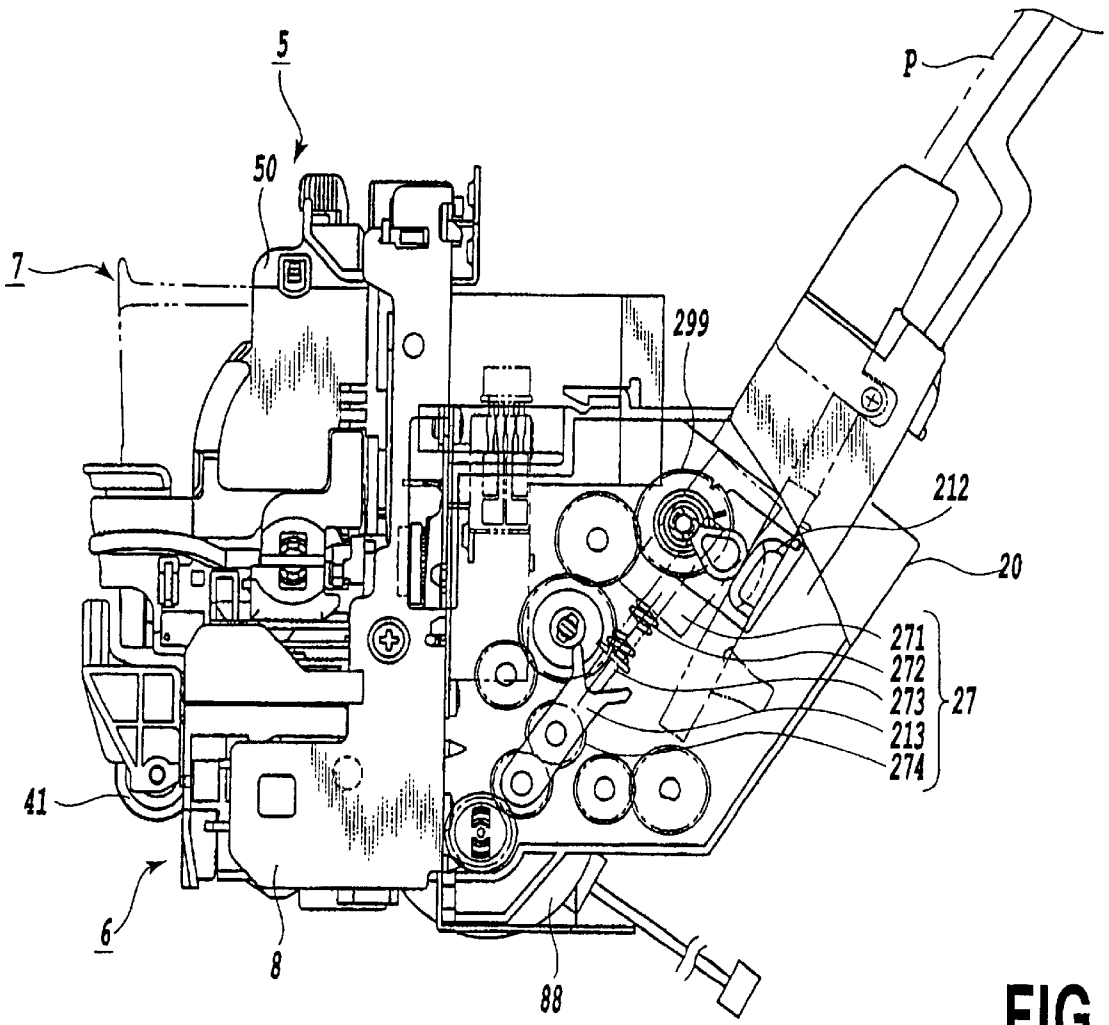
FIG. 2 is a side view of the printing apparatus.
Figure 3:
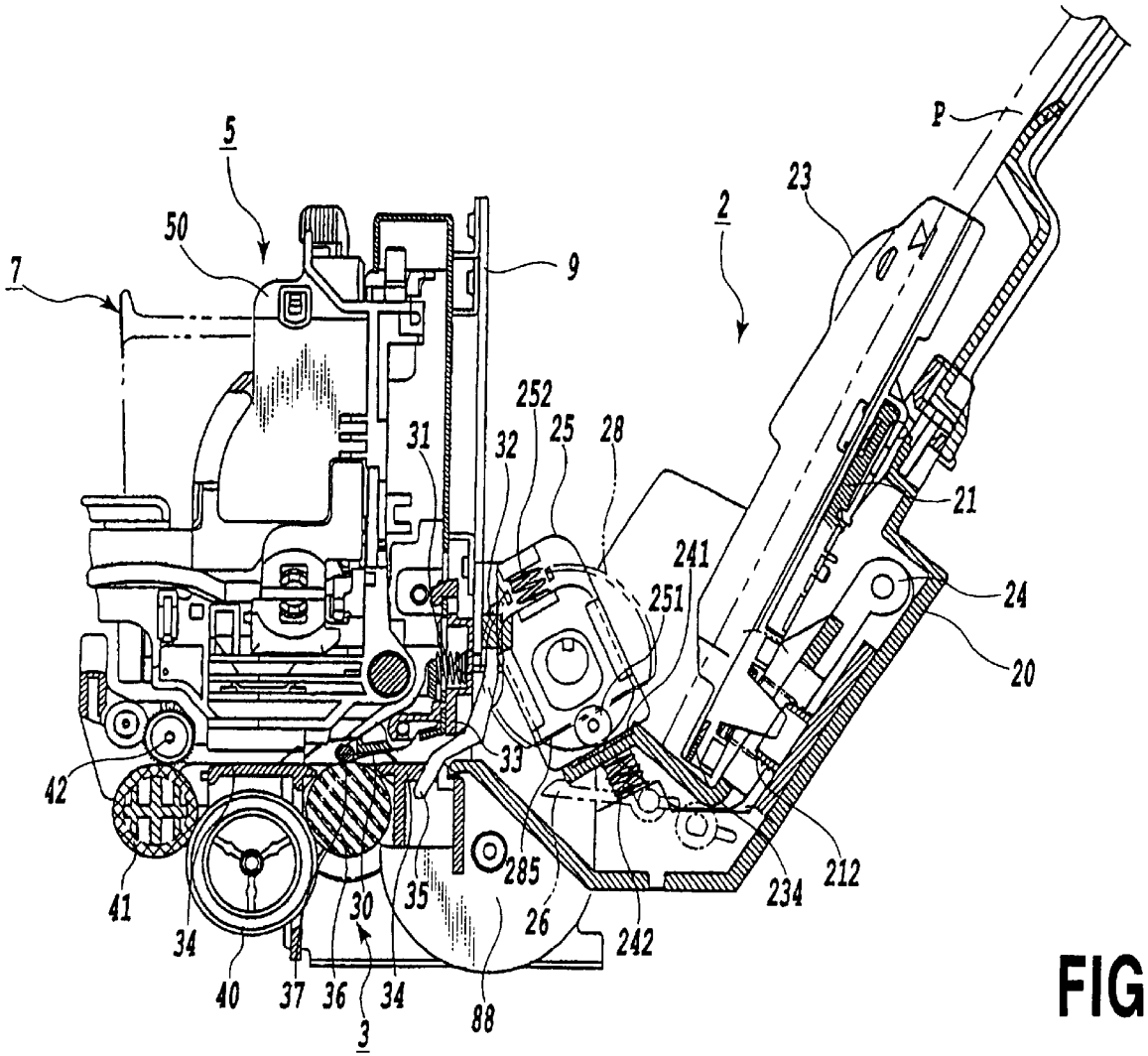
FIG. 3 is a transverse sectional view of the printing apparatus.

The mechanism sections are shown in FIGS. 1 to 3. FIG. 1 is a front view of this printing apparatus, FIG. 2 is a side view thereof, and FIG. 3 is a traverse sectional view thereof. The above mentioned mechanism sections will be described below mainly with reference to the transverse sectional view of this printing apparatus shown in FIG. 3.

(A) Sheet Feeding Section (Sheet Feeding Unit)

In FIG. 3, the sheet feeding section 2 is constructed by installing the automatic sheet feeding unit in the printing apparatus main body. The automatic sheet feeding unit has a base 20, which is provided with a pressure plate 21 on which printing sheets P are loaded and a sheet feeding roller 28 that feeds the printing sheet P. The sheet feeding roller 28 has a D-shaped cross section formed by partially cutting a circle. The pressure plate 21 is equipped with a movable side guide 23 that can restrict the loaded position of the printing sheets P. The pressure plate 21 is rotatable around a rotating shaft formed on the base 20 so that the urging force of a pressure plate spring 212 can urge the printing sheets P loaded thereon toward the sheet feeding roller 28. Further, the pressure plate 21 and the movable side guide 23 have separating pads 213 (see FIG. 2) and 234 installed in sites thereof opposite to the sheet feeding roller 28 to prevent a plurality of printing sheets P from being fed while overlapping each other, the separating pads being each composed of a material such as artificial leather which has a large friction coefficient.

Further, the base 20 is equipped with a separating pad holder 24 which is rotatable around the rotating shaft installed on the base 20 and which is equipped with a separating pad 241 to separate the printing sheets P from one another. The printing sheets P are urged toward the sheet feeding roller 28 by a separating pad spring 242. Further, against the separating pad holder 24, a rotating roller holder 25, which has a rotating roller 251 mounted thereon, is urged in the direction opposite to the above urging direction by a rotating roller spring 252.

The automatic sheet feeding unit is equipped with a release cam gear 299 (see FIG. 2) to release the contact of the pressure plate 21 (or the printing sheets P loaded thereon) with the sheet feeding roller 28. Rotation of the gear is set so that when the pressure plate 21 lowers to a predetermined position, a cut portion 285 of the sheet feeding roller 28 is located opposite the separating pad 241. Thus, a predetermined space can be formed between the separating pad 241 and the sheet feeding roller 28. At the same time, the rotating roller 251 contacts with the separating pad 241 to prevent a plurality of printing sheets from being fed while overlapping each other.

As described above, in a standby state, the release cam gear 299 pushes the pressure plate 21 down to a predetermined position to clear the contact between the pressure plate 21 and the sheet feeding roller 28 and between the separating pad 241 and the sheet feeding roller 28. Then, in this state, when a driving force applied to drive a transportation roller 36 of the sheet transporting section 3, described later, is transmitted to the sheet feeding roller 28 and the release cam 299 via a gear or the like, the release cam 299 leaves the pressure plate 21, which is thus elevated to cause the sheet feeding roller 28 to contact the printing sheet P. As the sheet feeding roller 28 rotates, the printing sheet P is picked up and is then separated from other sheets by the separating pad 241 and fed to the sheet transporting section 3. Then, once the printing sheet P has been fed into the sheet transporting section 3, the contact of the sheet feeding roller 28 with both the pressure plate 21 and the separating pad 241 is cleared by the release cam gear 299. Furthermore, once the fed printing sheet P has been completely printed and discharged, a return lever 26 acts on the printing sheet P placed on the separating pad 241 to allow the printing sheet P to be returned to its loaded position on the pressure plate 21.

The return lever 26 and the sheet feeding roller 28 are driven by driving force for the transportation roller 36 transmitted via predetermined gears. The transmission of the driving force is switched by a solenoid 271, solenoid spring 272, solenoid pin 273, and planetary gear arm 274 of a drive switching section 27 (see FIG. 2). More specifically, when the solenoid pin 273 acts on the planetary gear arm 274 to restrict its movement, the driving force for the transportation roller 36 is not transmitted. On the other hand, when the solenoid pin 273 is separated from the planetary gear arm 274, the planetary gear arm 274 becomes free to transmit the driving force to the return lever 26 and the sheet feeding roller 28 as the transportation roller 36 rotates forward or backward.

(B) Sheet Transporting Section

A chassis 8 (see FIG. 2) formed by bending sheet metal and constituting a structural member of the printing apparatus main body has elements mounted thereon, which constitute the sheet transporting section 3. More specifically, the sheet transporting section 3 is constructed by including a pair of the transportation roller 36 and a pinch roller 37, provided at an upstream side of the printing area covered by the printing head, in the transporting direction, and a pair of a sheet discharging roller 41 and a spur 42, provided at a downstream side of the printing area in the same direction. The transportation roller 36 is formed by coating the surface of a metal shaft with ceramic particles, and has shafts installed at the respective ends thereof and each supported by one of the two bearings 38 (one of them is shown in FIG. 1, and other is not shown) installed at the respective ends of a chassis 8.

A plurality of pinch rollers 37, which follow each other, are provided so that they can contact with the transportation roller 36. The pinch rollers 37 are held by a pinch roller holder 30, and when the holder is urged by a pinch roller spring 31, the pinch rollers 37 come into pressure contact with the transportation roller 36 to generate a force required to transport the printing sheet P. At this time, a rotating shaft of the pinch roller holder 30 is mounted on a bearing of an upper guide 33 installed on the chassis 8, and the pinch roller holder 30 rotates around this shaft. The pinch roller holder 30 is integrally formed and has fixed or higher rigidity in a direction in which the printing sheets P are transported. By further setting relatively low rigidity in a direction perpendicular to the above transportation direction, the urging force of the pinch roller spring 31 appropriately acts on the pinch rollers 37. Further, all the pinch rollers 37 are constructed substantially parallel with the rotating shaft of the transportation roller 36 (see FIG. 1) as described above. The pinch roller holder 30 and the upper guide 33 also act as a guide for the printing sheets P. Furthermore, an inlet of the sheet transporting section 3, to which the printing sheet P is transported from the above described sheet feeding portion 2, has a platen 34 disposed thereat to guide the printing sheet P. Further, the upper guide 33 is equipped with a PE sensor lever 35 that activates a PE sensor 32 for detecting front and back ends of the printing sheet P. Additionally, the platen 34 is mounted and positioned on the chassis 8. The pinch rollers 37 according to this embodiment are formed of resin such as POM which allows an object to slide well thereon, and each have an outer diameter set between about $\phi 3$ and 7 mm.

Further, the platen 34 has a sheet presser (not shown) installed on a sheet reference side thereof and which covers the corresponding end of the printing sheet P. Thus, even if the end of the printing sheet P is deformed or curved, it is prevented from floating to interfere with a carriage 50 or printing heads 7.

A carriage portion 5, described later, is constructed above the sheet transporting section 3. The carriage portion has the printing heads 7 mounted thereon which perform a scanning operation to eject ink to the printing sheet P for printing, the printing sheet P being transported by the pair of the transportation roller 36 and the punch roller 37 and the pair of the sheet discharging roller 41 and the spur 42. In this printing operation, the printing sheet P that has been fed to the sheet transporting section 3 is guided to the pair of the transportation rollers 36 and the pinch roller 37 by the platen 34, the pinch roller holder 30, and the upper guide 33. At this time, the PE sensor lever is operated by the front end of the transported printing sheet P, to detect the front end of the printing sheet P. Then, based on the result of the detection, a printing position on the printing sheet P can be determined. Further, an LF motor 88 drives and rotates the pair of the rollers 36 and 37 to transport the printing sheet P on the platen 34, and the transportation roller 36 has an encoder wheel 361 (see FIG. 1) mounted thereon to detect the rotary position thereof. The encoder wheel 361 is composed of a disk-shaped transparent sheet having radial markings formed thereon at predetermined pitches. The rotary position or quantity of rotation of the transportation roller 36 can be determined when an optical encoder sensor 362 (see FIG. 1) fixed to the chassis 8 detects these marks.

The carriage portion 5, as described before, has the printing heads 7 and ink tanks from which black and color inks are supplied to the printing heads 7, which are individually arranged for the respective ink colors and individually detachable from the carriage. Also as described above, the printing head 7 has a heater to heat the ink so that film boiling is caused in the ink to generate a bubble, and change in pressure caused by grow or contract of the bubble causes the ink to be ejected from the nozzles of the printing heads 7. Thus, printing of an image on the printing sheet P can be performed. The printing heads 7 for the respective color inks have the nozzles, constituting printing elements, arranged parallel with the direction in which the printing sheet is transported. Thus, inoperative nozzles can be set and this setting can be used to execute corrections according to an error in transportation of the printing sheet, as described later with reference to FIGS. 6A to 6C.

(C) Carriage Portion

The carriage portion 5 has a carriage 50, to which the printing heads 7 are mounted. The carriage 50 is supported by a guide shaft 81 (see FIG. 1) extending in the direction perpendicular to the direction in which the printing sheet P is transported and a similarly extending guide rail 82 (see FIG. 1) that holds a rear end of the carriage 50 to maintain a gap between the printing heads 7 and the printing sheet P.

Further, the carriage 50 is driven by a carriage motor 80 (see FIG. 1), which is mounted on the chassis 8, via a timing belt 83 (see FIG. 1). The timing belt 83 is extended and supported by idle pulleys 84 (see FIG. 1). Furthermore, the carriage 50 is equipped with a flexible substrate 56 (see FIG. 1) to transmit printing signals or the like from an electric substrate 9 constituting the above described control section, to the printing heads 7.

With the above configuration, for printing on the printing sheet P, the pair of the rollers 36 and 37 transports the printing sheet P to a row position to be printed (a position on the printing sheet P in the transportation direction), and the carriage motor 80 moves the carriage 50 to a column position to be printed (a position on the printing sheet P in the direction perpendicular to the transportation direction) to scan the printing heads 7 on the printing sheet. Then, during this scanning operation, on the basis of printing signals or the like from the control section, the printing heads 7 are driven to eject the ink to the printing sheet P, thereby printing the image or the like.

(D) Sheet Discharging Section

The pair of the sheet discharging roller and spur in the sheet transporting section constitute a sheet discharging section. More specifically, a spur base 341 (see FIG. 1) has the spurs 42 rotatably provided therein correspondingly to the sheet discharging rollers 41 and against which the spurs are contacted. The sheet discharging rollers 41 can be driven by a transmission roller 40 that transmits driving force for the transportation roller 36 to the sheet discharging roller.

The sheet discharging rollers 41 are formed as a plurality of roller portions each of which is made of a high-friction material such as rubber, and is disposed on a shaft consisting of metal or resin (see FIG. 1). Further, each of the spurs 42 has a thickness of about 0.1 mm, has protrusions formed on its outer circumference, and is composed of a metal plate such as SUS (stainless steel) and a resin portion consisting of POM and forming a rotating bearing.

The transmission roller 40, which transmits driving force to the sheet discharging roller 41, is disk shaped, is composed of POM or the like, and has a low-hardness and high-friction material such as styrene-based elastomer attached on the outer circumference thereof. The transmission roller 40 is contacted against both the transportation roller 36 and the sheet discharging roller 41 at a predetermined pressure, thereby transmitting driving force therebetween.

With the above configuration, the printing sheet P on which printing has been carried out through a scanning operation of the printing heads of the carriage portion 5 is transported while being held by nipping of the sheet discharging roller 41 and spur 42, and is then discharged to a sheet discharging tray or the like. During this transportation, once the back end of the printing sheet P has slipped out from the transportation roller 36 and the pinch roller 37, the printing sheet P is transported or discharged while being held only by the sheet discharging roller 41 and spur 42 of the sheet discharging section. Then, a printing operation is performed or the printing sheet is discharged. Further, a spur cleaner contacts each of the spurs 42 to enable ink and the like deposited on the spur 42 to be removed.

(E) Cleaning Section

A cleaning section 6 (see FIGS. 1 and 2) has a pump (not shown) used for ejection recovery operation for the printing heads 7 and a cap (not shown) that restrains the ink in each nozzle of the printing head from drying.

Figure 4:
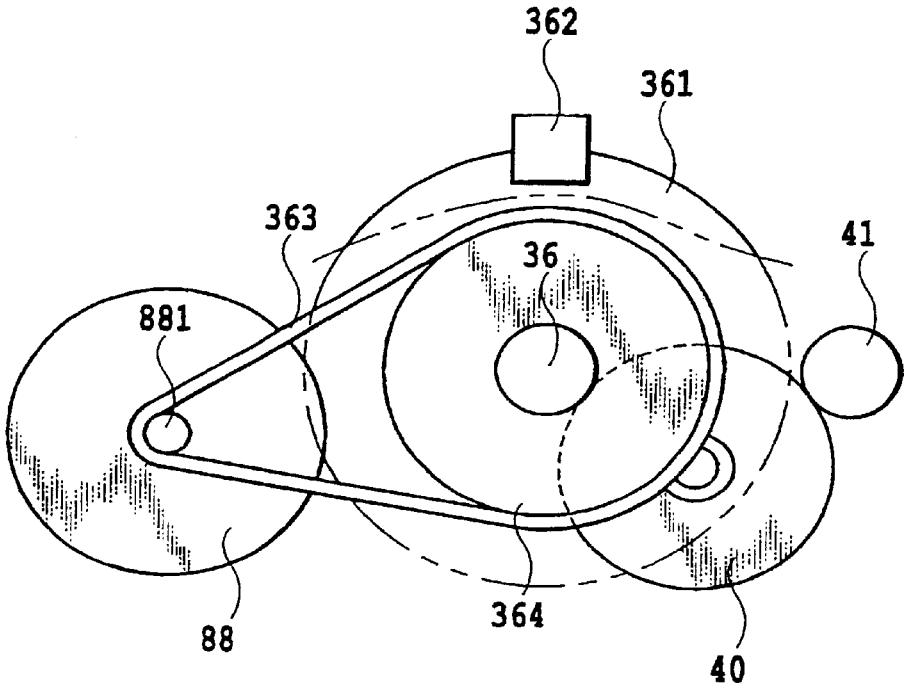
FIG. 4 is a view showing mainly a mechanism of the printing apparatus, which detects a quantity of rotation of a transportation roller.

FIG. 4 is a view useful in describing a detection mechanism that detects a rotary position or quantity of rotation of the transportation roller 36.

As described above, the transportation roller 36 has an encoder wheel 361 mounted thereon. Specifically, the encoder wheel 361 can be centered by press fitting it to the rotating shaft of the transportation roller 36, and is bonded to an LF pulley 364 to increase its strength. The encoder wheel 361 is, as shown in FIG. 4, a disk-shaped, and transparent sheet, and has radial markings formed thereon at predetermined pitches. With respect to the encoder wheel, an optical encoder sensor 362 is provided in a fixed state for detecting the markings on the encoder wheel 361 to determine the rotary position or quantity of rotation of the transportation roller 36. That is, each time any of the marks on the encoder wheel 361 reaches the position of the encoder sensor 362 as the transportation roller 36 rotates, a corresponding detection signal is generated and transmitted to the control section. The control section counts the number of detection signals starting with a predetermined reference rotary position to determine the rotary position or quantity of rotation of the transportation roller 36. The detected quantity of rotation can be used for an image position correcting process, described later in FIGS. 6A to 6C.

The transportation roller 36 is driven by transmitting the driving force of the LF motor 88 via an LF belt 363, as shown in FIG. 4. More specifically, the above transmission can be carried out by installing an LF belt 363, at a predetermined pressure, on an LF motor pulley 881 attached to the LF motor 88 and on an LF pulley 364 attached to the transportation roller 36. Further, FIG. 4 shows configuration that transmits the driving force for the transportation roller 36 to the sheet discharging roller via the transmission roller 40, described previously.

The printing operation performed by the printing apparatus of the embodiment described above, notably the image position correction, will be described with reference to FIGS. 5 and 6A to 6C.

Figure 5:
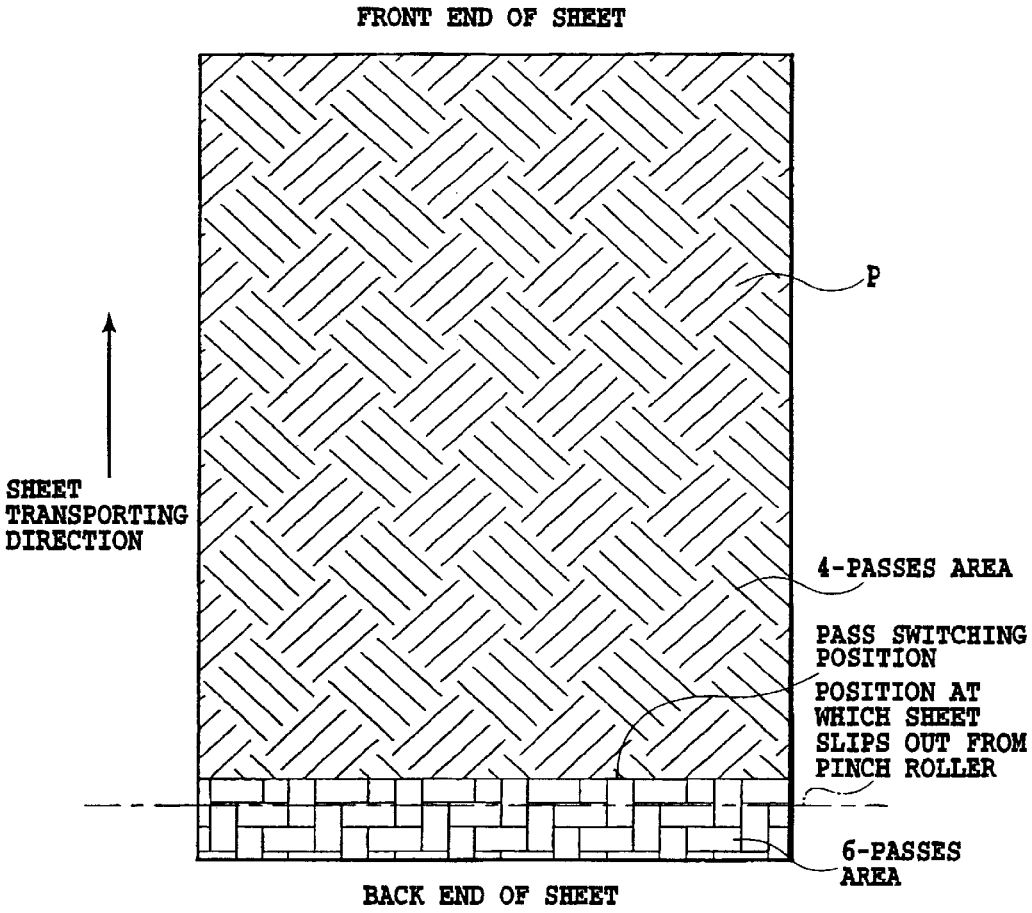
FIG. 5 is a view showing printing control according to the embodiment of the present invention on a basis of printing areas on a printing sheet.
Figure 6A:
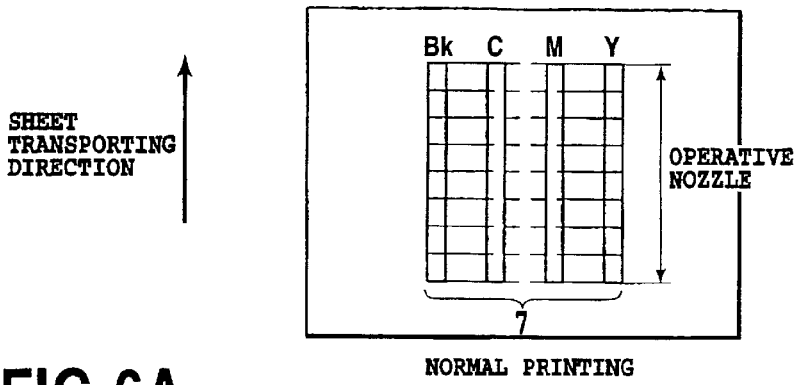
FIGS. 6A to 6C are views useful in describing the printing control for each printing area.
Figure 6B:
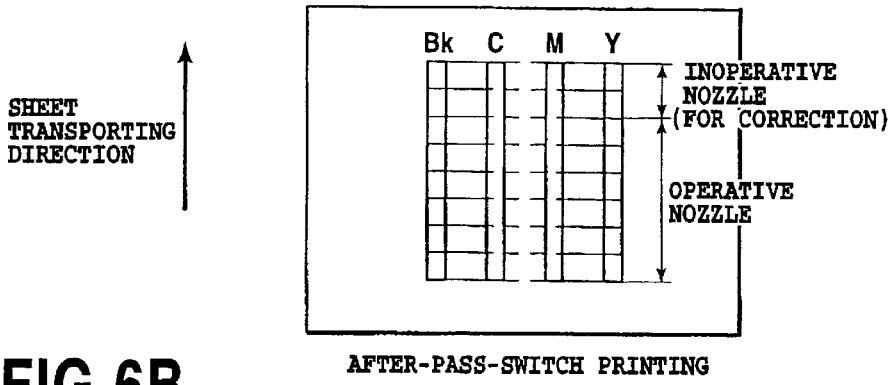
Figure 6C:
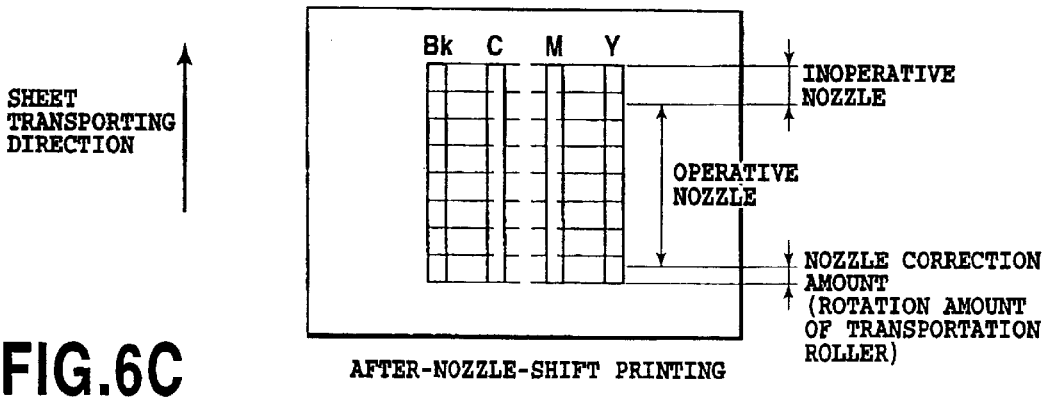

FIG. 5 is a view for explaining a process of controlling the printing operation differently for each area of the printing sheet and the like. FIGS. 6A to 6C show an operative range of the nozzles of the printing heads for each of the different printing control processes.

In this embodiment, a multipass printing process is executed in which a printing area printed through a scanning operation performed by the printing heads is printed through a plurality times of scanning operation and different nozzles are used for the respective scanning operations. In this embodiment, the multipass printing process is controlled differently between an area completely printed through four scanning operations (4-passes area) and an area completely printed through six scanning operations (6-passes area), as shown in FIG. 5. More specifically, in the 4-passes area, four nozzle blocks obtained by dividing all the nozzles of the printing heads into four are used, and the normal printing operation shown in FIG. 6A is performed in the corresponding areas. In the 6-passes area, six nozzle blocks obtained by dividing six-eighths of all the nozzles into six are used, and basically the after-pass-switch printing operation shown in FIG. 6B is performed.

In the transportation for printing on a back end portion of the printing sheet P, the back end of the printing sheet slips out from the pair of the transportation roller and pinch roller, located upstream, and is transported only by the pair of the sheet discharging roller and the spur, located downstream. In this case, since transportation accuracy may decrease, an amount of printing sheet transported during a single transporting operation is reduced to lessen possible transportation errors. At the same time, the number of times the scanning operation is performed for the same printing area in the multi-pass printing process is increased to make unevenness of print density, which may be caused by the above transportation errors, unnoticeable. Because of this, in this embodiment, the 6-passes area is provided correspondingly to the back end portion of the printing sheet transported, so that the amount of printing sheet transported during a single transporting operation is smaller than in the 4-pass area and six passes (six times of scanning operation) are executed.

The number of passes is controlled to be switched when the "pass switching position" of the printing sheet P, shown in FIG. 5, reaches the position at the pair of the transportation roller 36 and the pinch roller 37 in the transportation of the printing sheet. This position can be detected by, for example, detecting the front end of the printing sheet and then detecting that a predetermined number of transporting operations (or a predetenmined amount of rotation of the transportation roller) corresponding to this position have been performed from detecting of the front end.

In the transportation of the printing sheet, when the printing sheet passes the above pass switching position and then reaches the position at which the printing sheet slips out from the transportation roller and the pinch roller (i.e., the back end of the printing sheet leaves the pair of the rollers 36 and 37), basically the after-pass-switch printing operation is performed as shown in FIG. 6B. However, as described below, when it has been detected that the printing sheet has been transported a distance longer than a predetermined one, then immediately after the detection, the after-nozzle-shift printing operation shown in FIG. 6C is performed.

During the normal printing operation shown in FIG. 6A, each of the printing heads 7 for black (Bk), cyan (C), magenta (M), and yellow (Y) uses all the nozzles to perform the 4-passes printing operation. Accordingly, the amount of printing sheet P transported during a single transporting operation is one-fourth of the entire nozzle arranged length, so that a printing area corresponding to the above one-fourth distance is completely printed through four times of scanning operation performed by the printing heads. As the printing sheet P is transported, the 4-passes printing operation is continuously performed until the above described "pass switching position" of the printing sheet P is reached, thereby completing printing this 4-pass area. In the final stage in which the 4-passes area is completely printed, some of the nozzles of each printing head are opposite to the 6-passes area. Thus, to avoid using these nozzles, the operative portion of the nozzles are shifted correspondingly to the amount of printing sheet transported during a single transporting operation, thus first completing printing only the 4-pass area. The switching between the numbers of passes is controlled in this manner in order to simplify software used, and of course the switching process is not limited to the above example.

Once the 4-passes area has been completely printed, the after-pass-switch printing operation shown in FIG. 6B is performed, that is, the operation is switched to the 6-pass printing. During this printing operation, the operative portion of the nozzles is limited by setting some of the operative nozzles of each printing head 7 as an inoperative portion. In this embodiment, two-eighths of the nozzles are set as an inoperative portion, with the remaining six-eighths of the nozzles used for printing. Since this operative range is used to perform the 6-pass printing operation, the amount of printing sheet P transported during a single transporting operation corresponds to one-eighth of the entire nozzle range length.

In the 6-pass printing operation, when the back end of the printing sheet P slips out from the transportation roller 36 and the pinch roller 37, the transportation roller 36 may be rotated more than a predetermined distance due to the pressure exerted by the pinch roller 37, as described before. This extra rotation is detected by the encoder wheel 361 and the encoder sensor 362, the extra amount of rotation of the transportation roller 36 is detected. Then, a correction amount is determined based on the detected extra amount, as shown in FIG. 6C, to shift the operative portion of the nozzles of each printing head 7 at a distance corresponding to the extra amount of rotation using the inoperative portion of the nozzles.

More specifically, the control section, which executes data processing and control of operations in the printing apparatus, for example refers to a table by the detected extra amount, obtains a number of nozzles corresponding to the extra rotation amount, and supplies printing data to a head driver so as to shift the operative nozzles as a whole correspondingly to the obtained number of nozzles. Strictly, though the detected extra amount does not always coincide with a shift amount, the above table is configured so that the most approximate shift amount is set to the detected extra amount. With the above processing, the operative portion of the nozzles of each printing head is shifted relative to the printing sheet P, which has been transported the extra distance, thereby preventing the position of the image printed on the printing sheet from deviating from parts of the image printed during previous scanning operations. Thus, according to this embodiment, even with the relative positional deviation of the printing head position from the printing sheet position, which may occur because the printing sheet is transported the extra distance when it slips out from the upstream roller pair, an appropriate printing operation can be performed without any printing degradation such as the positional deviation of the printed image.

Embodiment 2

This embodiment is directed to a method in which if the printing sheet is transported an extra distance upon leaving the above described upstream roller pair, this error is corrected using also the sheet discharging roller, located downstream.

Figure 7:
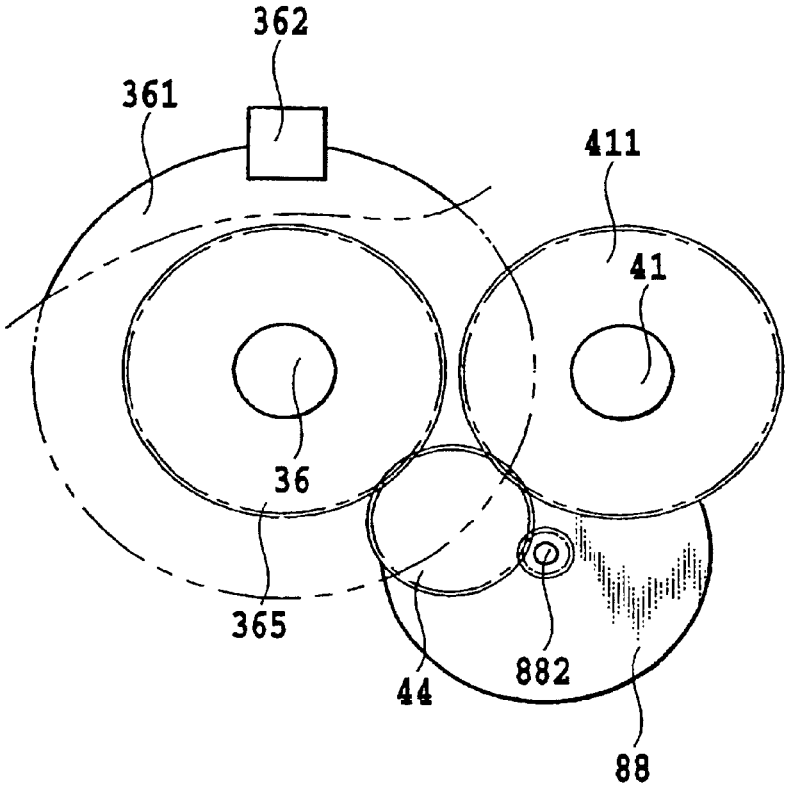
FIG. 7 is a view showing a mechanism that transmits driving force between a transportation roller and a sheet discharging roller according to a second embodiment of the present invention.

An arrangement that enables this correction is a gear train constitutes a transmission mechanism that transmits the driving force for the transportation roller 36 to the sheet discharging roller 41 instead of the transmission roller 40 of the above described embodiment, as shown in FIG. 7.

Specifically, as shown in FIG. 7, the arrangement is that a sheet-discharging idler gear 44 meshes with both an LF gear 365 and a sheet-discharging roller gear 411 installed on the transportation roller 36 and the sheet discharging roller 41, respectively, and the LF motor gear 881 of the LF motor 88 meshes with the sheet-discharging idler gear 44. This configuration reduces backlash that may exist in a gear train including the LF motor gear 881, sheet-discharging idler gear 44, LF gear 365, and sheet-discharging roller gear 411. As a result, the relationship between the rotary positions of the transportation roller 36 and sheet discharging roller 41 can be relatively precisely maintained.

Figure 8A:
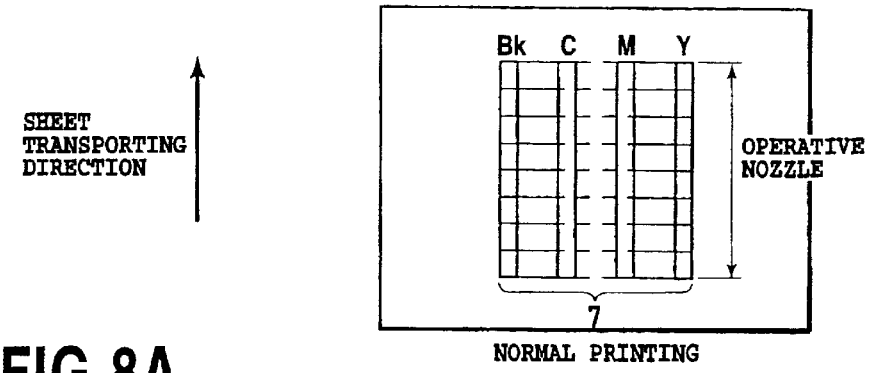
FIGS. 8A to 8C are views useful in describing printing control according to the second embodiment for each printing area.
Figure 8B:
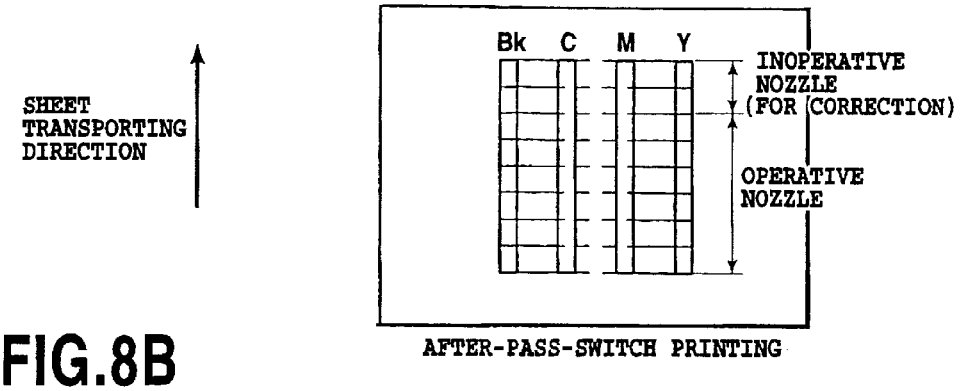

With the above configuration, print control similar to that in Embodiment 1, described above, is executed. That is, for the normal printing operation shown in FIG. 8A, the 4-passes printing operation is performed; all the nozzles of each printing head 7 are used, and the amount of printing sheet P transported corresponds to one-fourth of the entire nozzle length. Further, for the after-pass-switch printing operation shown in FIG. 8B, the 6-passes printing operation is performed. In this case, the operative portion of the nozzles of each printing head 7 is limited by setting some of the operative nozzles as an inoperative portion.

During this printing operation, when the back end of the printing sheet P slips out from the transportation roller 36 and the pinch roller 37 and the printing sheet is transported an extra distance, the quantity of rotation of the transportation roller 36 is detected so that the corrected amount can be detected.

Then, by using the inoperative portion of the nozzles of each printing head 7 the nozzles are shifted as in the case with Embodiment 1, described above, and the image printed position on the sheet P is corrected. In this correction, as shown in FIG. 8C, the amount of correction made by shifting the nozzles is increased above the extra amount of rotation of the transportation roller detected depending on the movement of the printing sheet P, thereby obtaining the final amount of correction for sheet transportation.

Figure 8C:
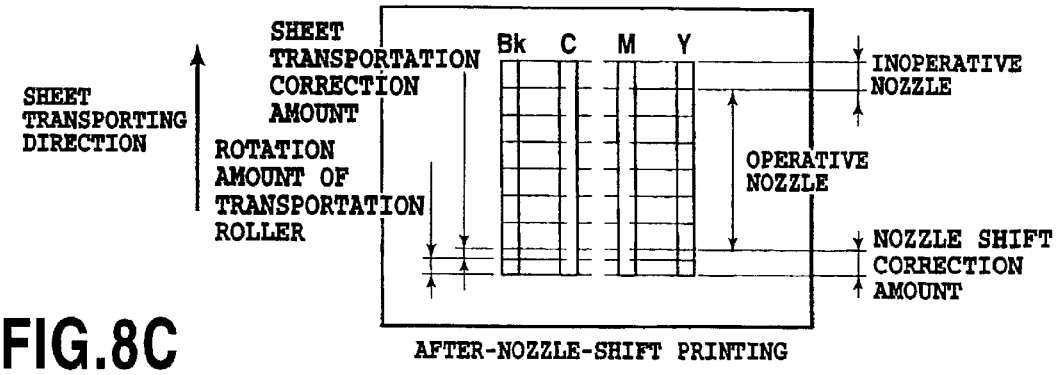

Specifically, as shown in FIG. 8C, the nozzles are shifted a distance corresponding to one-eighth of the entire nozzle length of each printing head (nozzle shift correction amount). Then, the image printed position is corrected by transporting the printing sheet P by rotating the sheet discharging roller 41 a distance corresponding to a difference (sheet transportation correction amount) between the movement amount of the printing sheet P (the amount of rotations of the transportation roller) and the nozzle shift amount.

Thus, if the printing sheet P is transported a distance longer than the amount of rotation of the transportation roller 36 to rotate the sheet discharging roller 41, the correction can be executed for the errors including an error due to the backlash which may exist in the gear train leading to the sheet discharging roller gear 411, thereby more precisely correcting the image printed position.

Embodiment 3

In the above two embodiments, the printing control is provided such that a 4-passes image is completed at a predetermined position from the back end of the printing sheet P and that the inoperative portion of the nozzles is then set for positional corrections. However, the inoperative portion of the nozzles for positional corrections may be set at the beginning of the printing operation. Furthermore, in the above embodiments, the printing control is provided for the multipass printing operation, but the present invention is applicable to a single-pass printing operation such as single-pass and bidirectional printing, as shown in FIG. 9.

Figure 10A:
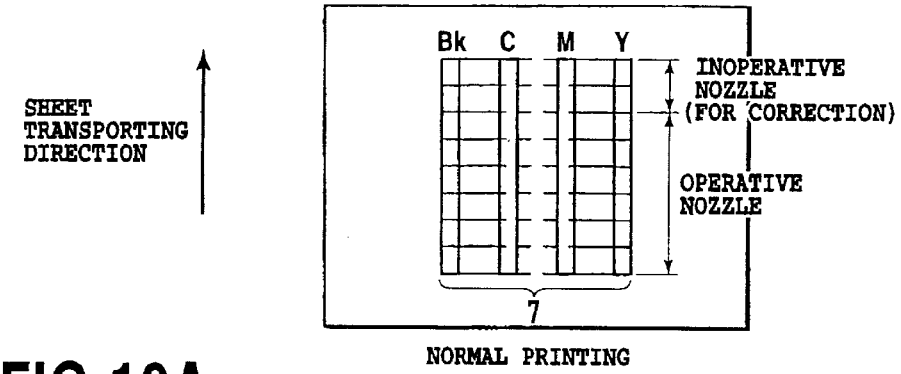
FIGS. 10A to 10C are views useful in describing printing control according to the third embodiment for each printing area.

Specifically, as shown in FIG. 10A, the inoperative portion of the nozzles for positional corrections is set at the beginning of the printing operation. In this embodiment, two-eighths of all the nozzles of each printing head are set as an inoperative portion. Then, without using this portion, the single-pass and bidirectional printing operation is performed using the remaining nozzle portion. Consequently, even if the transportation roller 36 has rotated a longer or shorter distance due to any trouble, the inoperative nozzles can be used for corrections.

Figure 9:
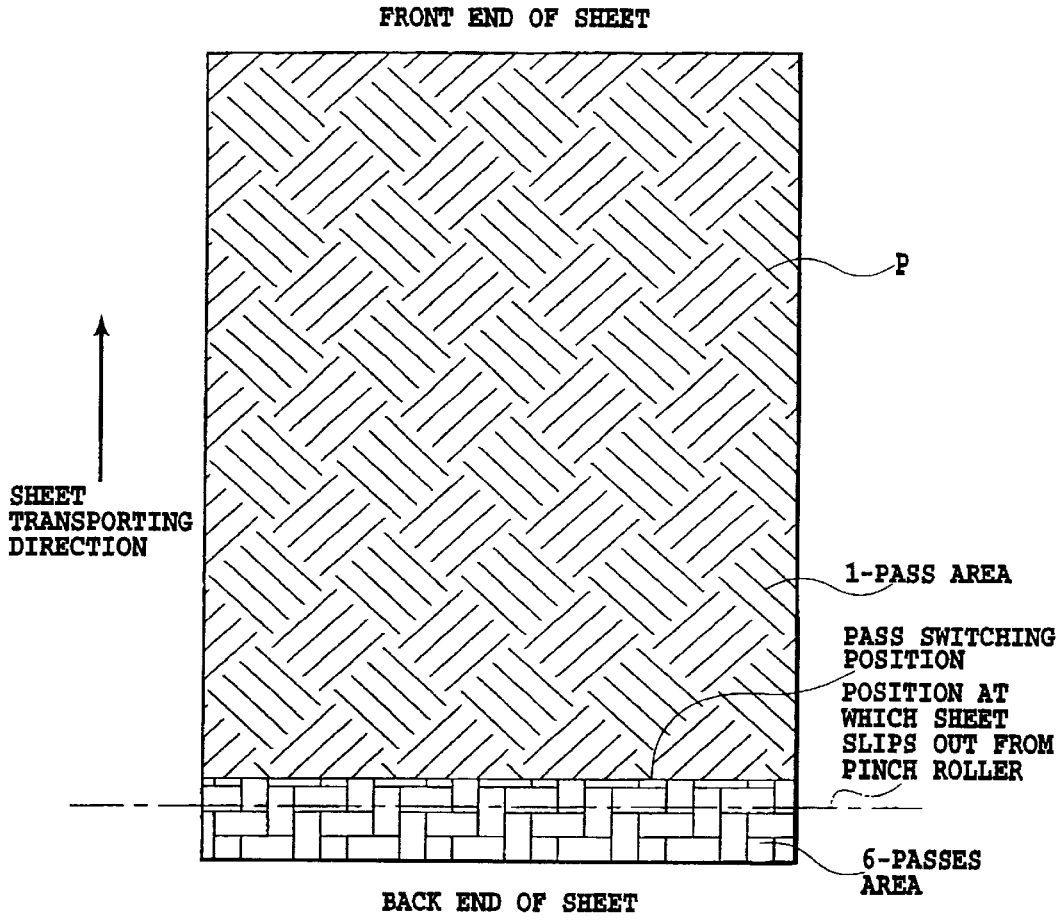
FIG. 9 is a view showing printing control according to a third embodiment of the present invention on a basis of printing areas on a printing sheet.
Figure 10B:
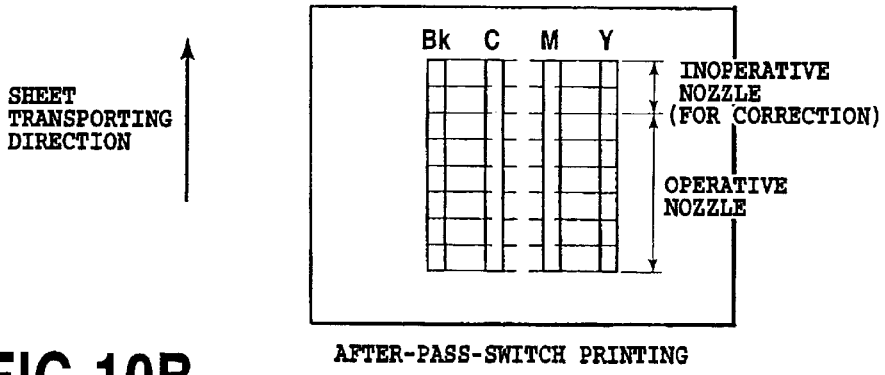

As shown in FIG. 9, the image is completed at a predetermined position from the back end of the printing sheet P. At this position, the back end of the printing sheet P is held by nipping of the transportation roller 36 and pinch roller 37. Once the image for 1 pass area is completed, the 6-pass printing operation is performed as described above. In this case, as shown in FIG. 10B, the operative portion of the nozzles of each printing head 7 is also limited by setting some of the operative nozzles as an inoperative portion. In this embodiment, as in the case with the normal printing operation, two-eighths of the nozzles are set as an inoperative portion, and the image is printed using the remaining nozzles, that is, six-eighths of all the nozzles. Thus, the printing sheet P is transported a distance corresponding to one-eighth of the entire nozzle length.

Figure 10C:
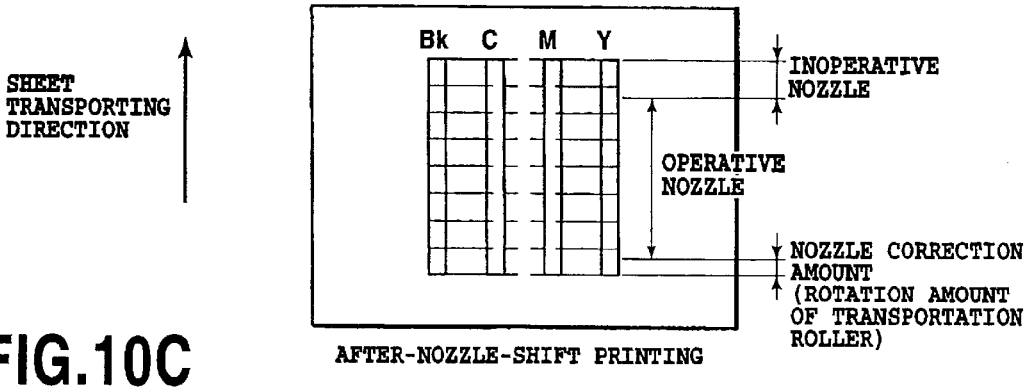
Figure 11:
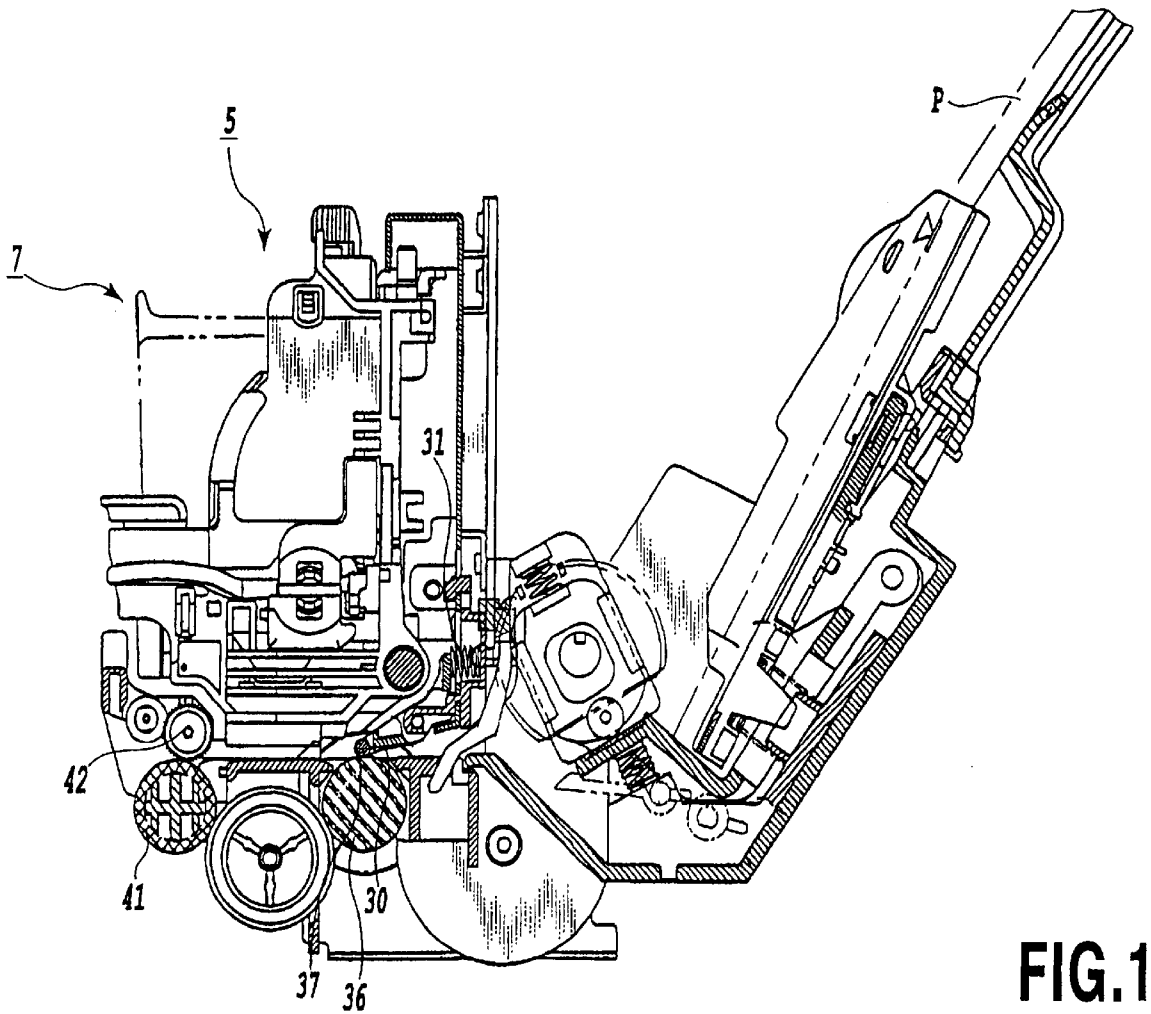
FIG. 11 is a transverse sectional view showing a printing apparatus according to a conventional example.
Figure 12A:
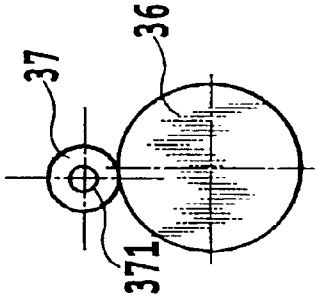
FIGS. 12A and 12B are views showing a relationship between a transportation roller and a pinch roller of the conventional printing apparatus.
Figure 12B:
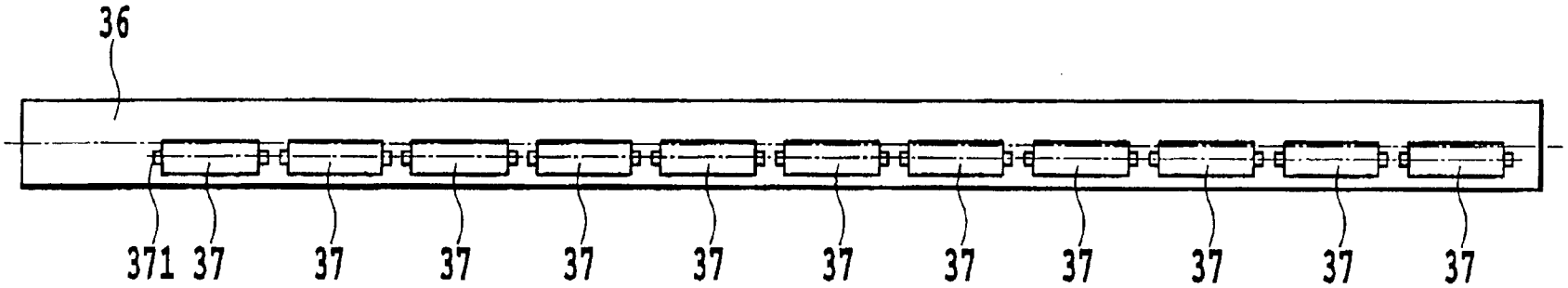

Then, when the back end of the printing sheet P slips out from the transportation roller 36 and the pinch roller 37, the amount of rotation of the transportation roller 36 is detected to determine the correction amount. Then, as shown in FIG. 10C, the image printing position on the printing sheet P can be corrected by using the inoperative portion of the nozzles of each printing head 7 to shift the nozzles as in the case with Embodiment 1.

The above embodiments have been described in conjunction with the printing heads based on the ink jet method, notably what is called the BJ method, but the present invention is applicable without depending on these printing methods for the printing heads, as is apparent from the description of the embodiments. As a printing method for the printing heads, for example, a piezo method may be used instead of the BJ method. Alternatively, printing heads may be used which are based on a thermal transfer method or the like instead of the ink jet method and which thus have print elements arranged therein.

With the above described embodiments of the present invention, during transportation of the printing medium, when the pressing force, by urging means for pressing the printing medium against the transportation roller in order to generate transportation force, applied on the printing medium disappears, that is, when the printing medium slips out from the transportation roller and the urging means, and even when the printing medium is transported an extra distance due to its slip-out, those of the plurality of printing elements of the printing head, which are usually not used for printing, are used to shift the operative range of the printing elements so as to correct the deviation of the positions of the printing elements relative to the printing medium correspondingly to a transportation detected by the detecting means. This prevents a position of a printed image from deviating from a predetermined position expected from already printed image.

As a result, when the printing apparatus transports the printing medium such as the printing sheet, the simple configuration can be used to reduce the deviation of the image printing position resulting from the behavior of the printing sheet effected when its back end slips out from the upstream roller pair.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A printing apparatus which uses a printing head having a plurality of printing elements disposed thereon to perform printing on a printing medium, said apparatus comprising:

transportation means having a transportation roller and urging means for applying a pressing force on the printing medium to press the printing medium against said transportation roller, to perform transportation of the printing medium;

detection means for detecting an amount of rotation of said transportation roller to determine an amount of transportation of the printing medium; and correction means for shifting an operative range of the printing elements by using an inoperative printing element among the plurality of printing elements of the printing head correspondingly to the amount of transportation which said detection means detects when the pressing force applied on the printing medium by said urging means disappears, to correct a deviation of a position of the printing element relative to the printing medium.

2. A printing apparatus as claimed in claim 1, further comprising second transportation means, which is provided at a down stream side of said transportation means in the direction of transporting of the printing medium, having a second transportation roller and second urging means for applying a pressing force on said printing medium to press said printing medium against said second transportation roller, to perform transportation of the printing medium in association with said transportation means.

3. A printing apparatus as claimed in claim 2, wherein said correction means corrects the deviation of the position of the printing element by causing said second transportation means to perform the transportation, in addition to shifting the operative range of the printing element.

4. A printing apparatus as claimed in claim 1, further comprising control means for setting the inoperative printing element among the plurality of printing elements of the printing head and changing the amount of transportation by said transportation means correspondingly to setting of the inoperative printing element.

5. A printing apparatus as claimed in claim 4, wherein said control means sets a predetermined number of printing element blocks, among a plurality of printing element blocks formed by dividing the plurality of printing elements of the printing head, as the inoperative printing element, and changes the amount of transportation into that corresponding to one printing element block, and wherein the printing on a scanned area having a width corresponding to the changed amount of the transportation is performed by repeating the transportation at the changed amount a plurality of times and, for each transportation, scanning a different printing element block of the printing head to said scanned area.

6. A printing apparatus as claimed in claim 2, wherein said urging means of said transportation means includes a pinch roller and said second urging means of said second transportation means includes a spur.

7. A printing apparatus as claimed in claim 1, wherein said detection means includes an optical code wheel rotating around a rotation center that is the same as that of said transportation roller of said transportation means and a sensor obtaining a signal caused in conjunction with the optical code wheel.

8. A printing apparatus as claimed in claim 1, where each of the plurality of printing elements of the printing head includes a nozzle for ejecting ink and causes a bubble in the ink by utilizing thermal energy to eject the ink by pressure generation in the bubble.

9. A printing method which uses a printing head having a plurality of printing elements disposed thereon to perform printing on a printing medium, said method comprising the steps of:

providing transportation means having a transportation roller and urging means for applying a pressing force on the printing medium to press the printing medium against the transportation roller, to perform transportation of the printing medium;

detecting an amount of rotation of the transportation roller to determine an amount of transportation of the printing medium; and shifting an operative range of the printing elements by using an inoperative printing element among the plurality of printing elements of the printing head correspondingly to the amount of transportation which said detecting step detects when the pressing force applied on the printing medium by the urging means disappears, to correct a deviation of a position of the printing element relative to the printing medium.

10. A printing method as claimed in claim 9, further comprising the step of providing second transportation means at a down stream side of the transportation means in the direction of transporting of the printing medium, having a second transportation roller and second urging means for applying a pressing force on the printing medium to press the printing medium against the second transportation roller, to perform transportation of the printing medium in association with the transportation means.

11. A printing method as claimed in claim 10, wherein said correcting step corrects the deviation of the position of the printing element by causing the second transportation means to perform the transportation, in addition to shifting of the operative range of the printing element.

12. A printing method as claimed in claim 9, further comprising the control step of setting the inoperative printing element among the plurality of printing elements of the printing head and changing the amount of transportation by the transportation means correspondingly to setting of the inoperative printing element.

13. A printing method as claimed in claim 12, wherein said control step sets a predetermined number of printing element blocks, among a plurality of printing element blocks formed by dividing the plurality of printing elements of the printing head, as the inoperative printing element, and changes the amount of transportation into that corresponding to one printing element block, and wherein the printing on a scanned area having a width corresponding to the changed amount of the transportation is performed by repeating the transportation at the changed amount a plurality of times and, for each transportation, scanning a different printing element block of the printing head to the scanned area.

14. A printing method as claimed in claim 10, wherein the urging means of the transportation means includes a pinch roller and the second urging means of the second transportation means includes a spur.

15. A printing method as claimed in claim 9, wherein said detecting step detects an output from a sensor which obtains a signal caused in conjunction with an optical code wheel, which rotates around a rotation center that is the same as that of the transportation roller of the transportation means.

16. A printing method as claimed in claim 9, wherein each of the plurality of printing elements of the printing head includes a nozzle for ejecting ink and causes a bubble in the ink by utilizing thermal energy to eject the ink by pressure generation pressure in the bubble.

* * * * *

UNITED STATES PATENT AND TRADEMARK OFFICE

CERTIFICATE OF CORRECTION

PATENT NO. : 6,655,865 B2
DATED : December 2, 2003
INVENTOR(S) : Yanagi et al.

It is certified that error appears in the above-identified patent and that said Letters Patent is hereby corrected as shown below:

Column 2,
Line 18, “transportation roller” should read -- transportation roller 36 --.

Column 4,
Line 20, “control” should read -- controls --.
Line 33, “traverse” should read -- transverse --.

Column 6,
Line 67, “grow or contract” should read -- growth or contraction --.

Column 10,
Line 32, “example” should read -- example, --.
Line 60, “train” should read -- train, which --.

Signed and Sealed this

Fifteenth Day of June, 2004

JON W. DUDAS
*Acting Director of the United States Patent and Trademark Office*